United States Patent [19]

Augustijn

[11] 4,201,686

[45] May 6, 1980

[54] AQUEOUS LIQUID DETERGENT COMPOSITIONS CONTAINING MIXTURES OF NONIONIC SURFACTANTS

[75] Inventor: Govert J. P. Augustijn, Zeist, Netherlands

[73] Assignee: Lever Brothers Company, New York, N.Y.

[21] Appl. No.: 1,817

[22] Filed: Jan. 8, 1979

[30] Foreign Application Priority Data

Jan. 9, 1978 [GB] United Kingdom ..... 656/78

[51] Int. Cl.[2] ..... C11D 1/835; C11D 1/72

[52] U.S. Cl. ..... 252/174.22; 252/548; 252/DIG. 1; 252/DIG. 14

[58] Field of Search ..... 252/89, DIG. 1, DIG. 14, 252/547

[56] References Cited

U.S. PATENT DOCUMENTS

| | | | |
|---|---|---|---|
| 3,382,285 | 5/1968 | Egan et al. | 260/615 |
| 3,419,500 | 12/1968 | Rytter et al. | 252/89 |
| 3,691,081 | 9/1972 | Thompson et al. | 252/89 |
| 3,812,041 | 5/1974 | Inamorato | 252/89 |
| 3,931,033 | 1/1976 | Löhr et al. | 252/122 |
| 3,985,670 | 10/1976 | Berg et al. | 252/122 X |
| 4,058,473 | 11/1977 | Canter | 252/121 |
| 4,129,514 | 12/1978 | Caffarel | 252/89 R |
| 4,147,649 | 4/1979 | Arnau et al. | 252/89 R |

FOREIGN PATENT DOCUMENTS

| | | | |
|---|---|---|---|
| 2514676 | 10/1975 | Fed. Rep. of Germany | 252/89 NT |
| 2303850 | 11/1976 | France | 252/89 NT |

*Primary Examiner*—P. E. Willis, Jr.
*Attorney, Agent, or Firm*—Melvin H. Kurtz

[57] ABSTRACT

A stable, non-gelling, low-foaming unbuilt aqueous liquid detergent is obtained by inclusion, in an aqueous medium, of 25–45% of a ternary nonionic detergent mixture, wherein the nonionics are high-, medium- and low-ethoxylated fatty alcohols with specific alkyl chain lengths.

2 Claims, No Drawings

AQUEOUS LIQUID DETERGENT COMPOSITIONS CONTAINING MIXTURES OF NONIONIC SURFACTANTS

The present invention relates to an unbuilt aqueous liquid detergent composition.

More particularly it relates to an unbuilt aqueous liquid detergent composition, in which the synthetic detergent active material is or comprises a particular mixture of nonionic detergent surfactants.

Liquid detergent compositions on the basis of nonionic detergent surfactants are known. However, the incorporation of substantial amounts of such nonionic detergent surfactants may give rise to a number of problems, such as phase-separation or solidification of the nonionic detergent surfactant at lower temperatures, too high a foaming behaviour, or too high a viscosity.

It has already been proposed to use mixtures of different types of nonionic detergent surfactants in liquid detergents, to overcome some of these problems. Thus, it has been suggested in Swedish Pat. application No. 316,556 to use a mixture of a water-insoluble and a water-soluble nonionic detergent surfactant in detergent compositions, including liquid detergent surfactants. However, such formulations may tend to solidify at lower temperatures, and their foaming and detergency properties at lower temperatures is not always satisfactory.

It has also been proposed in German Pat. application No. 1,279,273 to use a ternary mixture of nonionic detergent surfactants, either as such or in admixture with alkyl polyglycolether sulphates, wherein the nonionic detergent surfactant mixture comprises water-insoluble and water-soluble nonionic detergent surfactants. However, again the foaming behaviour of such systems is not quite satisfactory. Recently, it has been proposed in Netherlands Pat. application No. 7104191 to use a ternary mixture of nonionic detergent surfactants derived from fatty alcohols, in which the mixture comprises 2–25% of a low ethoxylated (3–7 moles of ethylene oxide), 25–70% of a medium ethoxylated (8–19 moles of ethylene oxide), and 25–50% of a high ethoxylated (20–30 moles of ethylene oxide) fatty alcohol, in detergent compositions. This mixture, and the amounts proposed, is however unsuitable for inclusion in a liquid detergent composition, since it causes gelling, leading to a non-pourable mass.

It has now been found that the following specific nonionic detergent surfactant mixture can be incorporated in an aqueous medium to provide a stable, low-foaming, non-gelling unbuilt liquid detergent composition:

(a) 50–80% primary $C_{16}$-$C_{19}$ saturated fatty alcohol, condensed with 15–90 moles of ethylene oxide, (b) 5–25% primary $C_8$-$C_{12}$ saturated fatty alcohol, condensed with 6–10 moles of ethylene oxide, (c) 5–25% primary $C_{10}$-$C_{14}$ saturated fatty alcohol, condensed with 1–4 moles of ethylene oxide, the percentages being by weight of the sum of (a), (b) and (c), the total of (a), (b) and (c) together being 25–45% by weight of the final liquid detergent composition.

With this nonionic detergent surfactant mixture, a satisfactory low-foaming liquid detergent is obtained, which does not gel or solidify at lower temperatures, and which provides for a good detergency at lower temperatures, particularly a good oily-soil removing property.

The balance of the liquid detergent composition consists of an aqueous medium, which may contain solvents, such as alcohol, lower mono- and dialkylethers of glycols, organic buffering agents, such as alkanolamines (0–15%), enzymes, enzyme stabilisers, soil-suspending agents, germicides, colouring agents, perfumes, foam-depressors, such as monomeric and dimeric oleic acid (4–10%), hydrotropes, fluorescers and so on.

The term primary saturated fatty alcohol, used in the definition of the specific nonionic detergent surfactants of the invention, includes the natural as well as the synthetic fatty alcohols.

A typical example of nonionic detergent surfactant (a) is a linear synthetic fatty alcohol with 16–18 carbon atoms, condensed with 18 moles of ethylene oxide, or tallow fatty alcohol, condensed with 18 moles of ethylene oxide; a typical example of nonionic detergent surfactant (b) is a synthetic fatty alcohol with 9–11 carbon atoms, condensed with 8 moles of ethylene oxide, and a typical example of nonionic detergent surfactant (c) is lauryl alcohol, condensed with 2 moles of ethylene oxide.

The liquid detergent compositions of the invention are of the unbuilt type, which means that they do not include inorganic or organic builder salts in any significant amounts.

The invention is further illustrated by way of Example.

Example I

The following unbuilt aqueous liquid detergent composition was prepared by mixing the recited ingredients.

| | % by weight |
|---|---|
| $C_{16}$–$C_{18}$ linear primary alcohol, condensed with 18 moles of ethylene oxide | 21 |
| $C_9$–$C_{11}$ linear primary alcohol, condensed with 8 moles of ethylene oxide | 7 |
| lauryl alcohol, condensed with 2 moles of ethylene oxide | 7 |
| triethanolamine | 10 |
| dimeric oleic acid | 6.5 |
| sodium xylene sulphonate | 3 |
| boric acid-triethanolamine complex | 10 |
| protease | 0.5 |
| diethyleneglycol monoethyl ether | 10 |
| dye, perfume, fluorescer | 0.5 |
| water | balance |

Washing experiments were carried out in the following way, and the following results were obtained:

Example 2

The following liquid detergent composition was formulated, using a mixture of nonionics according to a prior art proposal (Dutch patent application 7104191).

| | % by weight |
|---|---|
| $C_9$–$C_{11}$ linear primary alcohol, condensed with 6 moles of ethylene oxide | 7 |
| tallow fatty alcohol, condensed with 10 moles of ethylene oxide | 14 |
| tallow fatty alcohol, condensed with moles of ethylene oxide | 14 |
| triethanolamine | 10 |
| dimeric oleic acid | 6.5 |
| sodium xylene sulphonate | 3 |

-continued

| | % by weight |
|---|---|
| boric acid-triethanolamine complex | 10 |
| protease | 0.5 |
| diethyleneglycol monoethyl ether | 10 |
| dye, perfume, fluorescer | 0.5 |
| water | balance |

This formulation was comparable to the formulation of Example 1 as regards washing and foaming performance; however, the formulation of Example 2 yielded, after cooling to 0° C. and bringing it again at room temperature, floating gel-structures, which needed two day to dissolve again.

Example 3

The following formulation provided for a stable clear, non-gelling liquid:

| | % by weight |
|---|---|
| $C_{16}$–$C_{18}$ linear primary alcohol, condensed with 18 moles of ethylene oxide | 22 |
| $C_9$–$C_{11}$ linear primary alcohol, condensed with 8 moles of ethylene oxide | 10 |
| lauryl alcohol, condensed with 2 moles of ethylene oxide | 3 |
| dimeric oleic acid | 6.5 |

-continued

| | % by weight |
|---|---|
| sodium xylene sulphonate | 3 |
| triethyleneglycol monoethyl ether | 10 |
| triethanolamine | 11 |
| protease | 0.5 |
| fluorescer, perfume, dye | 0.6 |
| water | balance |

I claim:

1. An aqueous liquid unbuilt detergent composition containing 25–45% by weight of a nonionic detergent surfactant mixture, said mixture consisting essentially of:

(a) 50–80% by weight of a primary $C_{16}$–$C_{19}$ saturated fatty alcohol, condensed with 15–19 moles of ethylene oxide;

(b) 5–25% by weight of a primary $C_8$–$C_{12}$ saturated fatty alcohol, condensed with 6–10 moles of ethylene oxide;

(c) 5–25% by weight of a primary $C_{10}$–$C_{14}$ saturated fatty alcohol, condensed with 1–4 moles of ethylene oxide.

2. The composition of claim 1, wherein (a) is a linear synthetic primary $C_{16}$–$C_{18}$ fatty alcohol, condensed with 18 moles of ethylene oxide;

(b) is a synthetic primary $C_9$–$C_{11}$ fatty alcohol, condensed with 8 moles of ethylene oxide, and (c) is lauryl alcohol, condensed with 2 moles of ethylene oxide.

* * * * *